United States Patent [19]

Hash

[11] 4,285,286

[45] Aug. 25, 1981

[54] TUFTED PILE FABRIC AND METHOD AND APPARATUS FOR MAKING SAME

[75] Inventor: Juel T. Hash, Ft. Oglethorpe, Ga.

[73] Assignee: Shirley M. Jorges, Ft. Oglethorpe, Ga. ; a part interest

[21] Appl. No.: 123,913

[22] Filed: Feb. 22, 1980

[51] Int. Cl.[3] ..... D05C 15/00

[52] U.S. Cl. ..... 112/79 R

[58] Field of Search ..... 112/79 R, 79 A, 79 FF

[56] References Cited

U.S. PATENT DOCUMENTS

| | | | |
|---|---|---|---|
| 2,879,729 | 3/1959 | McCutchen | 112/79 R |
| 2,990,792 | 7/1961 | Nowicki et al. | 112/79 A |
| 3,132,612 | 5/1964 | Hackney | 112/79 R |
| 3,626,878 | 12/1971 | Cobble | 112/79 R |

*Primary Examiner*—Ronald Feldbaum

*Attorney, Agent, or Firm*—Alan Ruderman

[57] ABSTRACT

Two tufted pile fabrics have pile tufts disposed on the base fabric in the form of rows of chains, with the chains in adjacent rows offset, one of the fabrics including loop pile that extend from between the chains. A tufting machine and method for producing the fabrics includes two staggered rows of needles with each needle cooperating with a primary looper and a transfer looper. The primary looper points in the direction of fabric feed while the transfer looper points in the opposite direction and has a bill above the bill of the primary looper and overlying a portion of it, the bill of the transfer looper being in a plane offset from its shank. The loopers rock oppositely to each other and when the primary looper sheds each loop it is seized and held by the transfer looper and entered by the needle as it descends to the primary looper. The transfer looper thereafter releases the loop which is concatenated about the succeeding loop. Another set of needles and loop pile loopers downstream from the first set produce the loop pile in the chain loops.

20 Claims, 12 Drawing Figures

TUFTED PILE FABRIC AND METHOD AND APPARATUS FOR MAKING SAME

BACKGROUND OF THE INVENTION

This invention relates to tufting machines and tufted fabrics and more particularly to a method and apparatus for forming a new fabric having tufted loops in the form of chain links disposed longitudinally in rows on the base fabric.

In the formation of tufted pile a plurality of laterally disposed yarn carrying needles are reciprocably driven through a base fabric longitudinally fed through the machine to form loops carried down below the fabric to be seized by loopers oscillating in timed relationship with the needles and which cross the needles just above the needle eye to seize the loop of yarn. In a loop pile machine the loopers point in the direction of feed of the base fabric and hold the seized loops while the needles are retracted from the base fabric, thereafter rocking away from the point of loop seizure to release the loops. When the needles start their next descent the loops have been released from the loopers and carried one stitch length away from the needle path. To form cut pile the loopers point in the direction opposite to the direction in which the fabric is being fed and cooperate with respective oscillating knives. Since the fabric and thus the loop is being fed toward the closed end of the looper the loop cannot be released and is not cut by the knife as the hook rocks away from the needle path, generally after about three loops have been so seized. The pile height of cut pile fabric depends solely upon the distance that the loopers are disposed below the backing fabric, while the pile height of loop pile depends upon the amount of yarn fed to the needle with the maximum being the distance from the loopers to the backing fabric.

The aesthetic appearance of a tufted fabric to a large extent depends upon what is known as the "cover" or "coverage" of the fabric. This is the amount of the yarn that appears on the base fabric, it being undesireable for the base fabric to be visable. Heretofor, the manner of obtaining greater cover has been to utilize more yarn, either by having higher pile heights or greater density, or both, the latter being determined by the lateral spacing or gauge between adjacent needles and loopers, and by the rate of fabric feed relative to the rate of needle reciprocation. Large utilization of yarn results from obtaining coverage in this manner. Since the largest single factor in the cost of producing tufted fabric is the amount, and thus the weight, of yarn in the fabric, the greater the coverage the higher the cost of the fabric. Consequently, it is highly desireable to have a high coverage product with a low face weight, i.e., small amount of yarn.

Tufted fabric is less expensive to produce than other known pile fabric producing methods and tufted fabric stylists are continually seeking attractive new patterning abilities and yarns for broadloom carpet, wall coverings, upholstery and drapery fabric. Thus, attempts have been made to produce various looks in a tufted fabric that are produced more expensively by for example, weaving and knitting. The knitted look and the crewel look are desireable for certain applications, particularly when the look can be obtained with the yarns of larger size or heavier deniers. No tufted fabric is presently known with these qualities nor with the unraveling characteristics of the product produced by those methods.

SUMMARY OF THE INVENTION

The present invention provides a tufted pile fabric having the pile tufts disposed on the base fabric in the form of chains extending longitudinally substantially parallel to the base fabric between stitching holes, and a method and apparatus for producing the fabric by concatenating successive tufting loops into a chain using a primary looper and a transfer looper oscillating out of phase with each other. Since the loops lie substantially flat against the base fabric a greater amount of yarn is capable of being placed on the face of the base fabric relative to the amount of yarn utilized, and the amount of yarn coverage while substantial does not result in the high face weight of yarn heretofor necessary for equivalent coverage. Moreover, adjacent rows of chains may be off set laterally to provide a fabric with exceptionally high coverage. The fabric has an attractive knitted appearance with berber or crewel effects suitable for use as a residential carpeting, automobile fabrics, wall coverings, upholstery and rugs. It also provides an excellent print base for carpeting and is ideal in public areas when used with heavier and/or larger yarn sizes because it will not unravel and has virtually no pile crushing possibilities.

In practicing the principles of the invention a base fabric is fed between a reciprocating needle and a pair of oscillating loopers. The needle penetrates the base fabric and forms a loop seized by the first or primary looper having a bill facing in the direction of fabric feed as the looper rocks toward the needle path. As the needle ascends the primary looper rocks away from the needle path and sheds the loop which is thereafter seized by the second or transfer looper having a bill facing oppositely to the direction of fabric feed and oscillating oppositely relatively to the primary looper. The transfer looper holds the loop for entry by the needle as it thereafter descends. The transfer looper thereafter rocks away from the needle path as the primary looper rocks into the needle path for seizing a subsequent loop. Thus, each loop is formed within a prior loop and as the needle begins to ascend the transfer looper releases the first loop which is concatenated about the subsequent loop.

The transfer looper has a loop seizing bill spaced above and overlying a portion of the bill of the primary looper and in transverse alignment therewith. The transfer loopers oscillate out of phase with the primary loopers. Preferably the transfer loopers are mounted on a common looper bar with the primary loopers and have mounting portions longitudinally intermediate adjacent primary loopers, the bill portions of the transfer loopers being bent into the aligned relationship with the primary loopers. The needle passes through the bend of the transfer looper at approximately bottom dead center, but is spaced from the transfer looper as it enters the loop held thereon.

Another feature of the invention contemplates the insertion of a loop pile tuft into each chain using another yarn system. The second yarn system may include a different type yarn with different twists, sizes and colors than that of the chain system. Moreover, it may be separately controlled and provide high and low loops in accordance with a pattern within the chain fabric. To provide this combination additional needles may be mounted for reciprocating into cooperation with loopers pointing in the direction of the fabric feed. The needles may be mounted in the needle bar with the chain producing needles and the loopers may be mounted in the same looper bar with the other loopers.

Consequently, it is a primary object of the present invention to provide a tufted pile fabric having concatenated loops and a method and apparatus for forming the fabric.

It is another object of the present invention to provide in a tufting machine apparatus for producing a pile fabric in the form of a chain against the base fabric and wherein the apparatus includes oscillating primary and secondary loopers, the primary loopers for seizing a loop from a reciprocating needle and subsequently shedding the loop onto the secondary loopers where it is held, concatenated with a subsequent loop and thereafter shed.

It is a further object of the present invention to provide in a tufting machine a pair of loopers cooperating with a reciprocating needle, in which the bill of a first of the loopers points in the direction of fabric feed for seizing a loop of yarn from the needle and in which the second looper points in the direction opposite to fabric feed for receiving a seized loop shed from the first looper and holding the loop for entry by the needle as it descends to form a subsequent loop.

It is a still further object of the present invention to provide in a tufting machine a first oscillating looper having a bill pointing in the direction in which the base fabric is fed and cooperating with a reciprocating needle to seize a loop of yarn and thereafter shed the loop, and a second looper having a bill pointing oppositely to the direction of fabric feed positioned closer to the base fabric than the first looper and aligned with the bill of the first looper in the direction of fabric feed for seizing the loop shed by the first looper, the second looper oscillating out of phase with the first looper and holding the loop for entry by the needle as it descends towards the loop seizing position of the first looper.

It is yet a further object of the present invention to provide in adjacent lateral rows in a tufting machine needles offset from each other in the direction of fabric feed, each needle cooperating with a respective primary looper for seizing a loop of yarn presented by the respective needle and thereafter shedding the loop, and a transfer looper associated with each primary looper for seizing the loop shed by the respective primary looper for concatenation with a subsequently formed loop to produce offset adjacent rows of concatenated loops.

It is yet a still further object of the present invention to provide a transfer looper for a tufting machine for use in combination with a loop pile looper for forming chain tufts wherein the transfer looper has a bill portion bent out of the plane of its mounting portion.

It is still yet a further object of the present invention to provide a fabric having tufted loops disposed within concatenated chain loops and a method and apparatus for forming the fabric.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
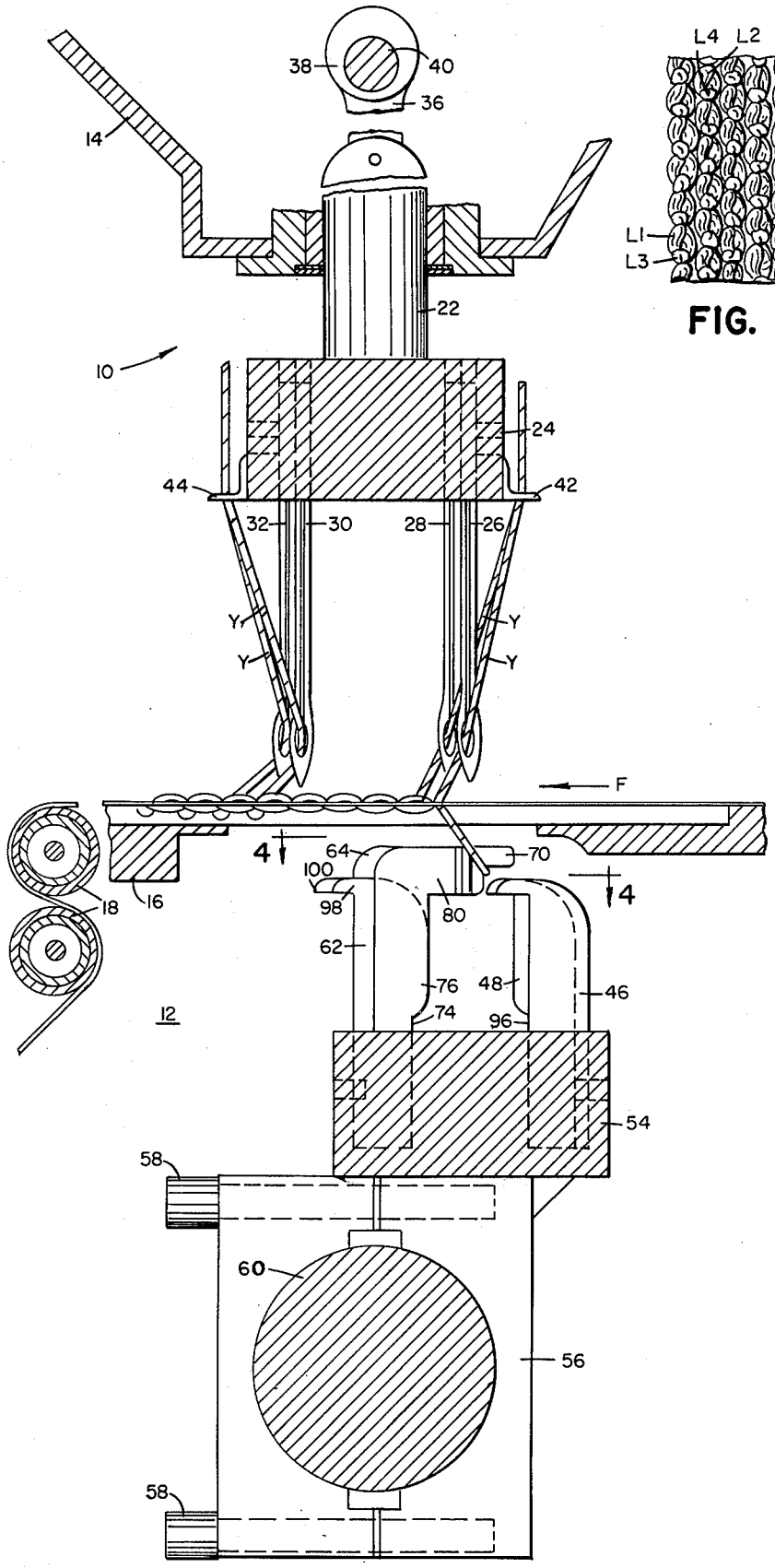
FIG. 1 is a vertical fragmentary sectional view taken transversely through a portion of a multiple needle tufting machine embodying apparatus construction in accordance with the principles of the present invention and illustrating portions of the machine in somewhat diagrammatic form.

Referring now to the drawings, there is illustrated in FIG. 1 a portion of a tufting machine 10 having a frame comprising a bed 12 and a head 14 disposed above the bed. The bed 12 includes a bed plate 16 across which a fabric F is adapted to be fed by a pair of take-off rolls 18 and feed rolls 20.

Mounted in the head 14 for vertical reciprocation is one of a plurality of push rods 22 to the lower end of which a needle bar 24 is carried and which in turn carries a first set of a plurality of needles 26 and 28 in a first pair of transverse rows and a second set of a plurality of needles 30 and 32 in a second pair of transverse rows spaced downstream of the needles 26 and 28 in the direction of fabric feed. The needles are adapted to penetrate the fabric through wire support fingers 34 positioned across an opening in the bed plate 16 upon reciprocation of the needle bar to carry yarn Y therethrough and projects loops of yarn from the fabric. Endwise reciprocation may be coventionally imparted to the push rods 22 and thus the needle bar by a link 36 pivotably connected at its lower end to the push rods and at its upper end to an eccentric 38 on a driven rotary main shaft 40 that is journalled transversely through the head 14. Yarn jerkers 42 and 44 are carried by the needle bar 24 and operate to engage yarn between the respective rows of needles 26, 28 and 30, 32 and respective conventional yarn feed mechanisms (not illustrated) for each transverse pair of needle rows.

Mounted within the bed for cooperation with the needles 26, 28 are a plurality of conventional loop pile loopers 46,48 which have bills which point in the direction of fabric feed, the loopers 46 cooperating with the needles 26 and the loopers 48 cooperating with the needles 28 to seize loops of yarn presented by the needles. The loopers 46,48 have mounting portions receivable within respective slots 50, 52 in a looper bar 54. Secured to the looper bar 54 is one half of a plurality of two piece clamps 56 which are secured by screws 58 about a looper shaft 60 journalled in the bed substantially parallel to the main shaft 40. The looper shaft 60 is conventionally oscillated or rocked in a back and forth manner in timed relationship with the reciprocation of the needles so that the hooks of the loopers 46,48 enter the respective loops presented by the needles 26,28, seize the loops, and as the loopers rock away from the needle path as the needles ascend, shed the loops which are moved downstream along with the fabric F. To simplify the disclosure, the means for oscillating the looper shaft is not illustrated since this is notoriously well known in the tufting art and any conventional means can be utilized with the present invention. One means for accomplishing this may be a cam and lever means driven off the main shaft 40.

In accordance with the present invention a second or transfer looper 62 is mounted to cooperate with the looper 46 and a second or transfer looper 64 is mounted to cooperate with the looper 48. The loopers 62 and 64 have respective free end portions 66,68 including bills 70,72 which point oppositely to the direction of fabric feed and thus oppositely to the bill portions of the loopers 46, 48. The loopers 62,64 are positioned downstream of respective loopers 46,48 as hereinafter described in further detail, and are oscillated out of phase with the loopers 46,48. Thus, as the loopers 46, 48 rock toward the center line of the needle path from a first side thereof the loopers 62 and 64 rock away from the center line of the needle path from the same direction. In the preferred embodiment of the invention this out of phase oscillation is simply provided by mounting the loopers 62,64 in the same looper bar 54 as the loopers 46,48.

With the exception of an undercut 74 the shank 76 to form the mounting portion of the loopers 62, for purposes hereafter described, the loopers 62 and 64 are identical in construction and only looper 62 will be described in detail.

Figure 3:
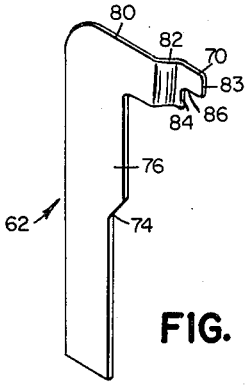
FIG. 3 is a perspective view of a transfer looper of the present invention.

As best illustrated in FIG. 3 the loopers 62 comprise an upstanding shank 76 the lower end of which is the mounting portion receivable within slots 78 in the looper bar 54, (slots 79 receiving the loopers 64) and from the top of which the free end 66 in the form of an arm or blade 80, angularly extends and terminates in the bill 70. The blade 80 has a bend 82 such that the plane of the bill 70 is laterally offset from the plane of the shank 76. The leading edge or tip 83 above the bill 70 is disposed downwardly from the top edge and the rear portion of the bill has an edge 84 disposed downwardly beyond the lower edge 86 of the tip of the bill. The edge 84 defines a throat beyond which a loop of yarn seized by the bill 70 is prevented from moving and the bottom edge 86 is the edge against which the loop is seized. The length of the shank 76 is longer than the shanks of the loopers 46 and 48 such that when the loopers 62 and 64 are inserted within their respective slots 78 and 79 in the looper bar 54 the bill 70 is disposed closer to the backing fabric F than the free end bill portions of the loopers 46 and 48. Moreover, the slots 78 and 79 are offset from the slots 50 and 52 with each slot 78,79 transversely intermediate but spaced downstream from respective adjacent slots 50 and 52, the bend 82 being such that although the shanks 76 of the loopers 62,64 are offset from the shanks of corresponding loopers 46,48, the bill portions 70 of the loopers 62,64 are aligned with the bills of planar loopers 46,48. The bill 70 is not only laterally aligned with the corresponding looper 46, 48 but is of a length such that it is superposed over at least the leading tip of the bill of those loopers. Preferably, the length of the bill 70 is such that it overlays a portion of the bill of the respective looper 46,48 by some finite amount; good results being obtained when the bill 70 overlays about half of the bill of the respective cooperating looper 46,48.

Figure 4:
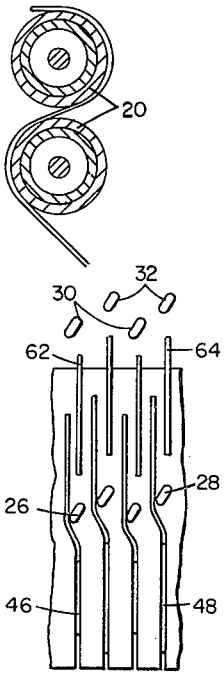
FIG. 4 is a sectional view taken substantially along the line 4—4 of FIG. 1 but with the needles in a descended position.
Figure 6:
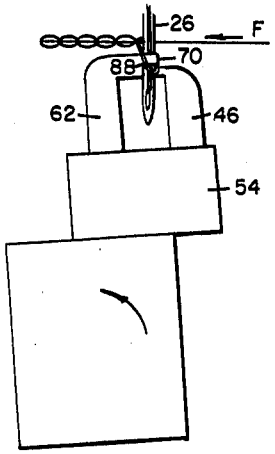
FIG. 6 is a schematic representation of the chain forming instrumentalities in an operative position preparatory to forming a loop.
Figure 7:
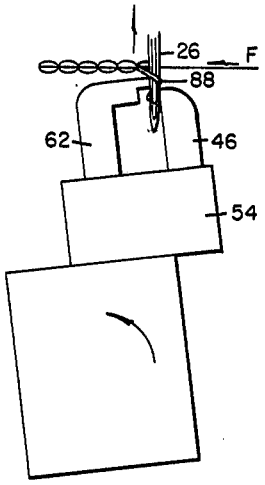
FIG. 7 is a view similar to FIG. 6 disclosing a second operative position of the chain pile forming instrumentalities.
Figure 8:
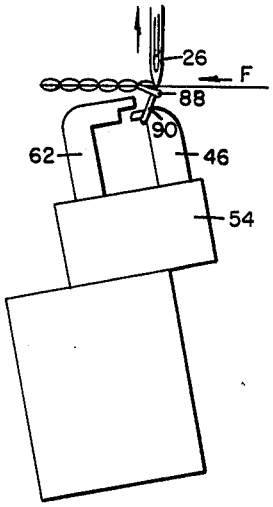
FIG. 8 is a view similar to FIG. 7 disclosing a third operative position.
Figure 9:
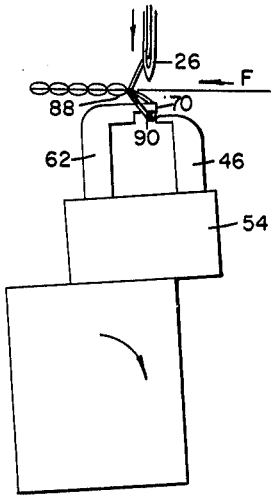
FIG. 9 is a view similar to FIG. 8 disclosing a fourth operative position.
Figure 10:
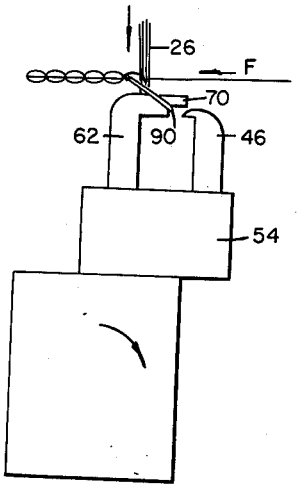
FIG. 10 is a view similar to FIG. 9 disclosing a fifth operative position.

The operation of the machine can best be understood with reference to FIGS. 6 through 10 which illustrate schematically portions of the stitch forming cycle for the system comprising the needle 26, the looper 46, and the transfer looper 62. With reference to FIG. 6, the needle 26 has already penetrated the base fabric F and descended to its maximum or deepest penetration. The looper bar which at this time is rocking in the counter-clockwise direction as illustrated, carries the bill of the looper 46 toward the needle center line, and the looper 62, which has a previous loop 88 held thereon against the throat 84 and the edge 86 of the bill 70, is rocking away from the needle path. The needle 26 during its descent has entered the loop 88 held on the looper 62 and is at the bend 82 of the looper 62 in the position illustrated in FIG. 4. After the needle begins its ascent, as illustrated in FIG. 7, the bill of the looper 46 has entered the new loop presented by the needle 26 as the looper bar 54 continues to rock counter-clockwise. At this point in the cycle the loop 88 is being released from the bill 70 of the looper 62 by the action of the looper 62 being rocked further from the needle center line and the loop being restrained from movement with the looper by the needle 26 and by the needle pushing against the bill 70. In FIG. 8 the looper bar 54 is illustrated at approximately its maximum counter-clockwise extent, and the new loop 90 has been seized by the bill of the looper 46. The loop 88 has been completely shed by the looper 62 and is concatenated as a chain link about the new loop 90. FIG. 9 illustrates the position of the stitch forming instrumentalities just after the needle has begun its descent and the looper bar 54 is rocking clockwise. The looper 46 is illustrated in the position as shedding the loop 90 from its bill onto the bill of the looper 62, while the previously formed loop 88 is secure against the base fabric F. In FIG. 10 the looper bar is continuing to rock clockwise with the looper 46 moving away from the needle center line. The needle 26 as it continues its descent is rearwardly of the bend 82 so easily passes through the loop 90 which has been seized and is being held by the bill 70 of the looper 62. The process is continued to form a succession of concatenated loops.

Figure 2:
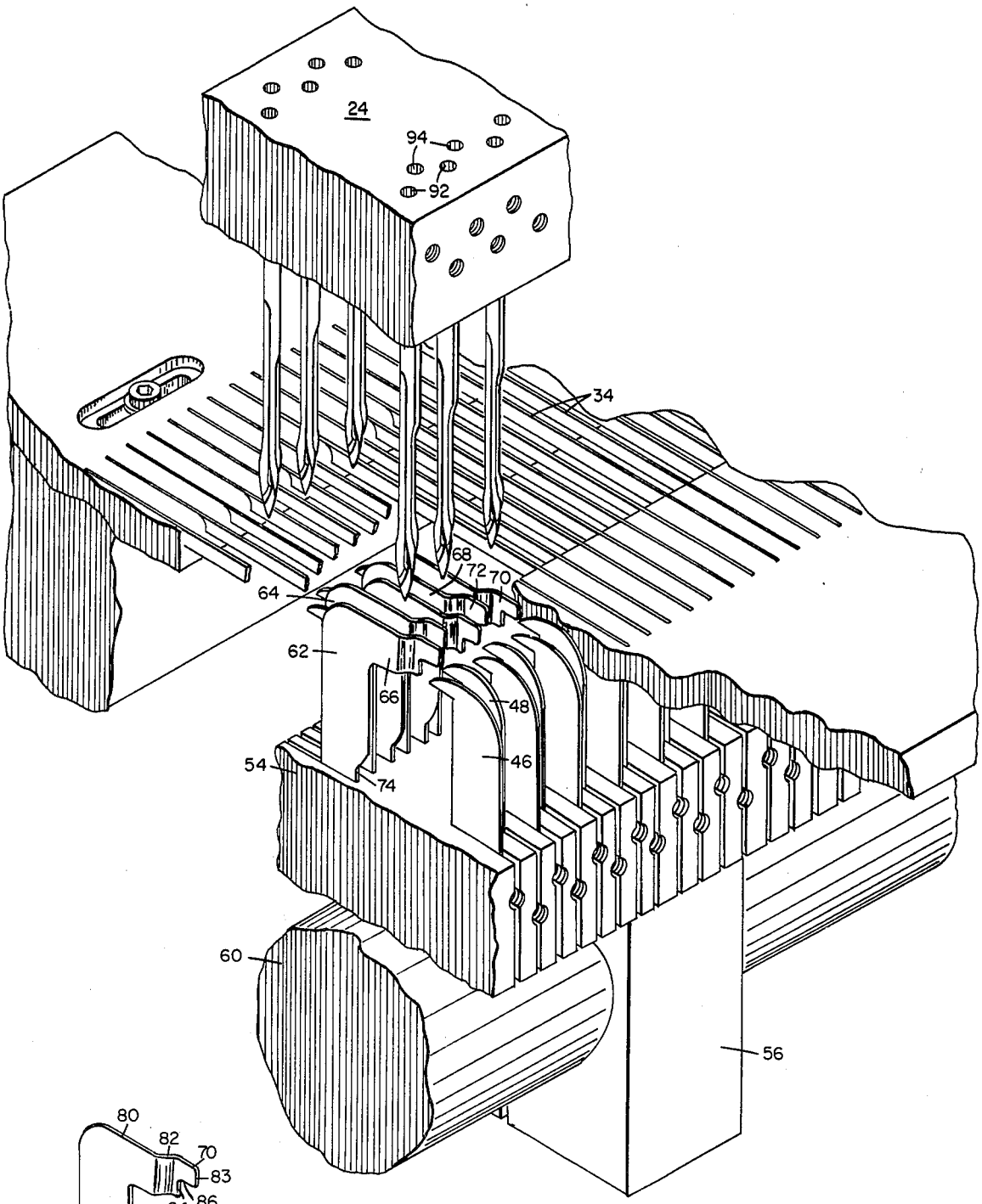
FIG. 2 is a fragmentary perspective view of the stitch forming instrumentalities of the tufting machine illustrated in FIG. 1.

It should be understood that the needles 28 cooperate with the loopers 48 and the loopers 64 in the same manner as the needles 26 cooperate with the loopers 46 and 62. The needles 28 are offset in the direction transverse to the feed line of the base fabric to provide a staggered needle arrangement. Thus, as best illustrated in FIG. 2 the needles 26 are received within needle holes 92 in the needle bar 24 and the needles 28 are received within holes 94 offset transversely from the holes 92 downstream along the line of fabric feed. Consequently, the loopers 48 are offset from the loopers 46 by an amount similar to the offset or stagger between the needles 28 and 26, and the loopers 62 and 64 are similarly offset. The slots 50,52 78 and 79 in the looper bar 54, for manufacturing simplicity are cut into the looper bar the same depth along the line of feed. Thus, the loopers 48 include an undercut at 96 so that the loopers 46 and 48 may be otherwise identical, and the loopers 60 include the undercut 74. The depth of the undercut 74 and 96 being substantially equal to the offset or stagger between respective adjacent loopers.

Figure 11:
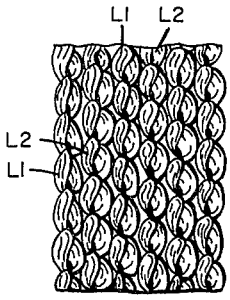
FIG. 11 is a fragmentary plan view of a tufted chain loop fabric produced in accordance with the present invention.

The apparatus thus far described produces a fabric as illustrated in FIG. 11 wherein the needles 26 produce the concatenated loops $L_1$ and the needles 28 produce the concatenated loops $L_2$. This product has exceptional coverage for the weight of yarn utilized, and when the larger size yarns are tufted the product provides a berber or crewel effect with full coverage and no portions of the base fabric visible. Moreover, when heavier yarns are tufted one leg of each loop overlies the other leg (depending upon the twist of the yarn) and gives a knitted appearance, and with certain yarns a herringbone appearance. Thus, attractive patterns can be produces by the utilization of yarns having different weights, sizes, twists, etc.

Figure 12:
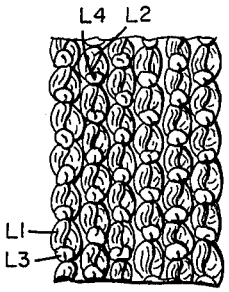
FIG. 12 is a fragmentary plan view of a tufted fabric having loop pile within concatenated chain loops as produced in accordance with the present invention.
Figure 5:
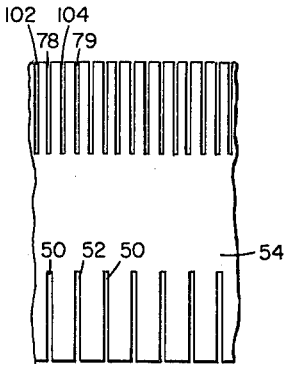
FIG. 5 is a fragmentary plan view of a looper bar constructed in accordance with one aspect of the present invention.

Another aspect of the present invention is the provision of the second set of staggered needels 30,32 which cooperate with another set of loopers 98 and 100 respectively. The loopers 98 and 100 being conventional loop pile loopers such as the loopers 46 and 48 and have bills which point in the direction the fabric feed. The loopers 98 and 100 are mounted within slots 102 and 104 respectively in the looper bar 54 at substantially the same downsteam location as the loopers 62 and 64, but the slots 102 are substantially transversely aligned with the slots 50, and the slots 104 are similarly aligned with the slots 52, so that the slots 102 and 104 are intermediate the slots 78 and 79 as illustrated in FIG. 5. With this construction a loop pile is formed every stroke of the machine which of course is equal to one stitch, and by proper spacing between the needles 26 and 30 and the needles 28 and 32, a loop tuft may be placed intermediate each pair of chain tufts, which ideally is at the previous penetration point of the base fabric. Thus, a unique fabric may be produced as illustrated in FIG. 12 with a pile loop $L_3$ at the intersection of each loop $L_1$ and a pile loop $L_4$ may be produced at the intersection of each pair of loops $L_2$.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. A method of tufting pile fabric comprising, supporting and feeding a base fabric in one direction, penetrating a yarn through the base fabric to form a first loop on one side of said fabric, supporting on said one side a first looper having a free end pointing in said one direction, relatively moving said looper so its free end enters and seizes said loop and thereafter sheds said loop, supporting upon said one side a second looper having a free end closer to said fabric than the free end of said first looper and pointing in the direction oppositely to said one direction, relatively moving said second looper to enter and seize the loop shed by said first looper and to hold said loop, penetrating the yarn through said fabric and said loop at a location displaced along the line of feed from the penetration of the first loop to form a second loop on said one side, relatively moving said first looper to seize the second loop, snd relatively moving said second looper to thereafter release said first loop.

2. A method of tufting pile fabric as recited in claim 1 wherein said first and second loopers move oppositely to each other relatively to each loop.

3. A method of tufting pile fabric as recited in claim 1 including subsequently penetrating another yarn through said base fabric substantially at the penetration of second loop to form a third loop, supporting on said one side a third looper having a free end pointing in said one direction, relatively moving said third looper so its free end enters and seizes said third loop and shedding said third loop to form a loop tuft intermediate said first and second loops.

4. A method of tufting pile fabric as recited in claim 3 wherein said first and third loopers move simultaneously toward and away from the respective loops.

5. A method of tufting pile fabric comprising supporting and feeding a base fabric in one direction, activating a yarn carrying needle to stitch the yarn continuously through the base fabric to form a row of successive yarn loops on one side of said fabric, supporting on said one side of said fabric a first looper having a free end pointing in said one direction, oscillating said looper so the free end enters and seizes and thereafter sheds the loops in succession, supporting upon said one side a second looper having a free end close to said fabric then the free end of the first looper and pointing in the direction oppositely to said one direction, oscillating said second looper so the free end enters and seizes each loop shed by the first looper, holding each loop on said second looper for entry into said held loop by said needle as it forms the successive loop, and releasing said held loop from the second looper subsequent to entry of the successive loop by said first looper.

6. A method of tufting pile fabric as recited in claim 5 including activating a second yarn carrying needle located along and transverse to the direction of feed of said first needle to stitch the second yarn continuously through said base fabric to form a second row of successive yarn loops on said one side of said fabric, the loops in said second row being offset in the direction of feed from the loops in the first row, supporting on said one side of said fabric a third looper having a free end pointing in said one direction, oscillating said third looper so the free end enters and seizes and thereafter sheds the loops in succession, supporting upon said one side a fourth looper having a free end closer to said fabric than the free end of the third looper and pointing in the direction oppositely to said one direction, oscillating said fourth looper so the free end enters and seizes each loop shed by the third looper, holding each seized loop on said fourth looper for entry into said held loop by said second needle as it forms the successive loop, and releasing said loop held on the fourth looper subsequent to entry of the successive loop by said third looper.

7. A method of tufting pile fabric as recited in claim 5 wherein said first and second loopers oscillate oppositely to each other relatively to each loop.

8. A method of tufting pile fabric as recited in claim 6 wherein said first and third loopers oscillate simultaneously toward and away from the respective loops and said second and fourth loopers oscillate oppositely to the respective first and third loopers relatively to each loop.

9. In a tufting machine having means for feedng a base fabric in one direction, a yarn carrying needle disposed on one side of the base fabric, means for reciprocating the needle for penetrating the base fabric and forming loops therein, means for supporting on the opposite side of the base fabric a first looper having a free end pointing in said one direction, and means for oscillating said looper toward and away from the path of said needle so that said free end enters, seizes and then sheds successive loops, the combination of a second looper having a free end including a bill, means for supporting the second looper on the opposite side of the base fabric with the bill disposed closer to said base fabric than the free end of said first looper and overlying at least a portion of the free end of said first looper, said bill being aligned with said free end of said first looper along the line of feed and pointing in the direction oppositely to the direction of fabric feed, and means for oscillating said second looper toward and away from the path of said needle such that as said first looper moves toward said path said second looper moves away from said path and as said second looper moves toward said path said first looper moves away from said path, so that said bill of the second looper enters, seizes and holds each loop of yarn shed from the first looper for penetration by the needle on the next succeeding penetration of the base fabric and thereafter releases said loop of yarn to form a chain loop pile.

10. In a tufting machine as recited in claim 9 wherein said means for supporting said second loopers includes a looper bar, said second looper comprising a body portion including a substantially planar shank and a blade portion, means for mounting said shank in said looper bar, said blade extending from said shank and terminating at said free end, said blade having a bend such that said bill lies in a plane offset from the plane of said shank.

11. In a tufting machine as recited in claim 10 wherein the bill of said second looper includes a tip, said tip being the extreme part of the second looper free end, said bill having a bottom edge extending from said tip, said blade including a bottom edge further from said base fabric than said bottom edge of said bill, and a throat defined between said bottom edges of said bill and said blade, said throat preventing loops seized by said second looper from entering said blade.

12. In a tufting machine as recited in claim 9 wherein said means for supporting said first looper and said means for supporting said second looper comprises a common looper bar.

13. In a tufting machine as recited in claim 9 including a second yarn carrying needle disposed in the line of feed and spaced in the direction of feed relatively to said first needle, means for reciprocating said second needle for penetrating said base fabric for forming loops therein, means for supporting on the opposite side of the base fabric a third looper having a free end pointing in said one direction, and means for oscillating said third looper toward and away from the path of said second needle so the free end enters, seizes and then sheds successive loops, said second needle being disposed for penetrating said base fabric at substantially the penetration of said first needle.

14. In a tufting machine having means for feeding a base fabric in one direction, a plurality of first and second yarn carrying needles disposed on one side of the base fabric, said needles being spaced apart transversely of the line of fabric feed, said first needles being staggered relatively to said second needles so that the first needles are in a first transverse row and said second needles are in a second transverse row, means for supporting on the opposite side of the base fabric first looper apparatus including a first looper for cooperating with each of said first and second needles, each first looper having a free end pointing in said one direction, and means for oscillating said first loopers toward and away from the path of the respective needle so that the free ends enter, seize and then shed successive loops, the combination of second looper apparatus including a second looper corresponding to each first looper, each second looper having a free end including a bill, means for supporting said second looper apparatus on the opposite side of the base fabric with the bills of said second loopers disposed closer to said base fabric than the free ends of said first loopers and overlying at least a portion of the free end of the respective first looper, said bills of each second looper being aligned with the free end of the respective first looper along the line of feed and pointing in the direction oppositely to the direction of fabric feed, and means for oscillating said second loopers toward and away from the path of the respective needle such that as each first looper moves toward the path of its corresponding needle the corresponding second looper moves away from said path and as each second looper moves toward said path the corresponding first looper moves away from said path, so that the bill of each second looper enters, seizes and holds each respective loop of yarn shed from the respective first looper for penetration by the corresponding needle on the next succeeding penetration of the base fabric and thereafter releases said respective loop of yarn thereby to form rows of chain pile with adjacent transverse rows offset.

15. In a tufting machine as recited in claim 14 wherein said means for supporting said second looper apparatus comprises a common looper bar.

16. In a tufting machine as recited in claim 14 wherein said means for supporting said second loopers includes a looper bar, said second looper each comprising a body portion including a substantially planar shank and a blade portion, means for mounting said shank in said looper bar, said blade extending from said shank and terminating at said free end, said blade having a bend such that said bill lies in a plane offset from the plane of said shank.

17. In a tufting machine as recited in claim 14 including a plurality of third yarn carrying needles, each third needle being disposed in the line of feed relatively to a respective first and second needle and spaced the same distance from the respective first and second needle in the direction of feed, means for reciprocating said third needles for penetrating the base fabric for forming loops therein, means for supporting on the opposite side of the base fabric third looper apparatus including a third looper corresponding to each first and second looper, each third looper having a free end pointing in said one direction, and means for oscillating said third looper apparatus toward and away from the path of a corresponding third needle so the free end of each third looper enters, seizes and then sheds successive loops presented by the respective third needles, said second needles being disposed for penetrating said base fabric at substantially the penetration of the respective first and second needles.

18. In a tufting machine as recited in claim 17 wherein said means for supporting said first, second and third looper apparatus comprises a common looper bar.

19. A transfer looper for use in a tufting machine in conjunction with a primary looper, said transfer looper comprising a body portion having a blade and a shank having a mounting portion, said blade extending angularly from said shank, a bill extending from the blade remote from the shank and terminating in a tip, said shank lying in a first plane, said blade including a bend such that said bill lies in a second plane offset from said first plane.

20. A transfer looper as recited in claim 19 wherein said blade has a bottom edge that extends from said shank, said bill having a top edge and a bottom edge extending from said tip, said bottom edge of said blade being spaced below the bottom edge of said bill relatively to said top edge to define a throat therebetween, said throat lying in the plane of said bill.

* * * * *